United States Patent [19]

Friedle et al.

[11] Patent Number: 4,681,056

[45] Date of Patent: Jul. 21, 1987

[54] OUTBOARD MOTOR EXTENSION HANDLE ASSEMBLY

[75] Inventors: Dennis J. Friedle, Lake Villa; Richard P. Kolb, Gages Lake; Gaylord M. Borst, Highland Park, all of Ill.

[73] Assignee: Outboard Marine Corporation, Waukegan, Ill.

[21] Appl. No.: 784,171

[22] Filed: Oct. 4, 1985

[51] Int. Cl.[4] ..... B63H 21/26

[52] U.S. Cl. ..... 114/146; 114/144 R; 279/43

[58] Field of Search ..... 114/144 R, 144 A, 146; 403/290; 294/19.1; 279/43, 50, 58

[56] References Cited

U.S. PATENT DOCUMENTS

| | | | |
|---|---|---|---|
| 200,203 | 2/1878 | Knox | 279/43 |
| 411,153 | 9/1889 | Lafferty | 279/7 |
| 1,072,378 | 9/1913 | Bauschlicher | 33/178 R |
| 1,265,113 | 5/1918 | Reimer et al. | 279/43 |
| 1,861,363 | 5/1932 | Scheuner | 403/289 |
| 2,056,963 | 10/1936 | Fuchs | 279/43 |
| 2,618,496 | 11/1952 | Johnson | 279/43 |
| 2,903,903 | 9/1959 | Jaromy | 74/471 |
| 3,144,178 | 8/1964 | Sarnoff | 222/327 |
| 3,174,357 | 3/1965 | Conklin | 74/480 |
| 3,595,126 | 8/1971 | Norton | 89/1.5 D |
| 3,955,438 | 5/1976 | Zakrzewski | 74/480 |
| 4,525,111 | 6/1985 | Gutsche | 279/43 |

*Primary Examiner*—Joseph F. Peters, Jr.
*Assistant Examiner*—C. T. Bartz
*Attorney, Agent, or Firm*—Michael, Best & Friedrich

[57] ABSTRACT

A marine propulsion device comprising a propulsion unit adapted to be pivotally mounted on the transom of a boat for pivotal movement relative to the transom about a generally vertical steering axis, the propulsion unit including a rotatably mounted propeller, and a powerhead drivingly connected to the propeller, a steering handle connected to the propulsion unit and extending generally horizontally therefrom for causing pivotal steering movement of the propulsion unit in response to lateral movement of the steering handle, and an extension handle assembly removably attached to the steering handle and including an extension handle, a coupling device including a plurality of fingers spaced around the steering handle and having respective inner ends pivotally connected to the extension handle, and respective outer ends biased outwardly from the steering handle, and a cylindrical sleeve surrounding the coupling device and being slideable around the fingers longitudinally thereof for moving the outer ends inwardly such that the fingers grasp the steering handle.

28 Claims, 6 Drawing Figures

OUTBOARD MOTOR EXTENSION HANDLE ASSEMBLY

BACKGROUND OF THE INVENTION

This invention relates to outboard motor steering handles, and, more particularly, to extension handle assemblies for outboard motor steering handles.

It is known to use extension handles removably attached to the steering handle of an outboard motor. Such extension handles are disclosed in Jaromy U.S. Pat. No. 2,903,903, Conklin U.S Pat. No. 3,174,357 and Zakrzewski U.S. Pat. No. 3,955,438.

Also known are connecting apparatus including a plurality of fingers adapted to extend around an object, and a sleeve movable relative to the fingers for moving the fingers inwardly to grasp the object. Such arrangements are disclosed in Knox U.S. Pat. No. 200,203, Lafferty U.S. Pat. No. 411,153, Bauschlicher U.S. Pat. No. 1,072,378, Reimer U.S. Pat. No. 1,265,113, Scheuner U.S. Pat. No. 1,861,363, Sarnoff U.S. Pat. No. 3,144,178 and Norton U.S. Pat. No. 3,595,126.

SUMMARY OF THE INVENTION

The invention provides a marine propulsion device comprising a propulsion unit adapted to be pivotally mounted on the transom of a boat for pivotal movement relative to the transom about a generally vertical steering axis, the propulsion unit including a rotatably mounted propeller, and a powerhead drivingly connected to the propeller, a steering handle connected to the propulsion unit and extending generally horizontally therefrom for causing pivotal steering movement of the propulsion unit in response to lateral movement of the steering handle, and an extension handle assembly removably attached to the steering handle and including an extension handle, a coupling device including a plurality of fingers spaced around the steering handle and having respective inner ends pivotally connected to the extension handle, and respective outer ends biased outwardly from the steering handle, and cylindrical sleeve means surrounding the coupling device and being slideable around the fingers longitudinally thereof for moving the outer ends inwardly such that the fingers grasp the steering handle.

The invention also provides an extension handle assembly adapted to be removably attached to an outboard motor steering handle, the assembly comprising an extension handle, a coupling device having a longitudinal axis and including a plurality of fingers spaced around the longitudinal axis and having respective inner ends pivotally connected to the extension handle, and respective outer ends biased outwardly from the longitudinal axis, the fingers being adapted to have the steering handle inserted therewithin, and cylindrical sleeve means surrounding the coupling device and being slideable around the fingers longitudinally thereof for moving the outer ends inwardly such that the fingers grasp the steering handle.

In one embodiment, the assembly further comprises means for limiting movement of the sleeve means relative to the coupling device and in the direction from the outer ends to the inner ends.

In one embodiment, the sleeve means includes a generally cylindrical inner surface, and the limiting means includes, on the coupling device, projection means, and means extending inwardly from the inner surface for engaging the projection means.

In one embodiment, the projection means includes a pin extending through the coupling device and having a portion extending outwardly from the coupling device, and the engaging means includes an annular ridge extending inwardly from the inner surface of the sleeve means.

In one embodiment, the assembly further comprises means for securing the sleeve means in a position locking the fingers around the steering handle.

In one embodiment, the securing means includes, on the fingers, respective outer surfaces having thereon detent means, and, on the sleeve means, a generally cylindrical inner surface, and means extending inwardly from the inner surface for engaging the detent means.

In one embodiment, the detent means includes an annular groove extending around the outer surfaces of the fingers, and the engaging means includes an annular ridge exending inwardly from the inner surface and being receivable in the groove.

In one embodiment, the fingers include respective projections extending inwardly toward the longitudinal axis for engaging the handle.

In one embodiment, the coupling device further includes a main portion connected to the extension handle and having the fingers pivotally connected thereto.

In one embodiment, the main portion of the coupling device includes a cylindrical recess adapted to receive a portion of the steering handle, and the fingers are connected to the main portion around the recess.

In one embodiment, the extension handle has an inner end, and the main portion of the coupling device includes a cylindrical recess receiving the inner end of the extension handle.

In one embodiment, the assembly further comprises means for securing the inner end of the extension handle to the coupling device.

In one embodiment, the securing means includes a pin extending through the main portion of the coupling device and through the inner end of the extension handle.

In one embodiment, the fingers have respective outer surfaces, and the sleeve means includes a generally cylindrical inner surface, and an annular ridge extending inwardly from the inner surface and engaging the outer surfaces.

A principle feature of the invention is the above-described extension handle assembly. This extension handle assembly includes effective connecting means with a simple construction and with no removable parts.

Other features and advantages of the invention will become apparent to those skilled in the art upon review of the following detailed description, claims, and drawings.

Figure 1:
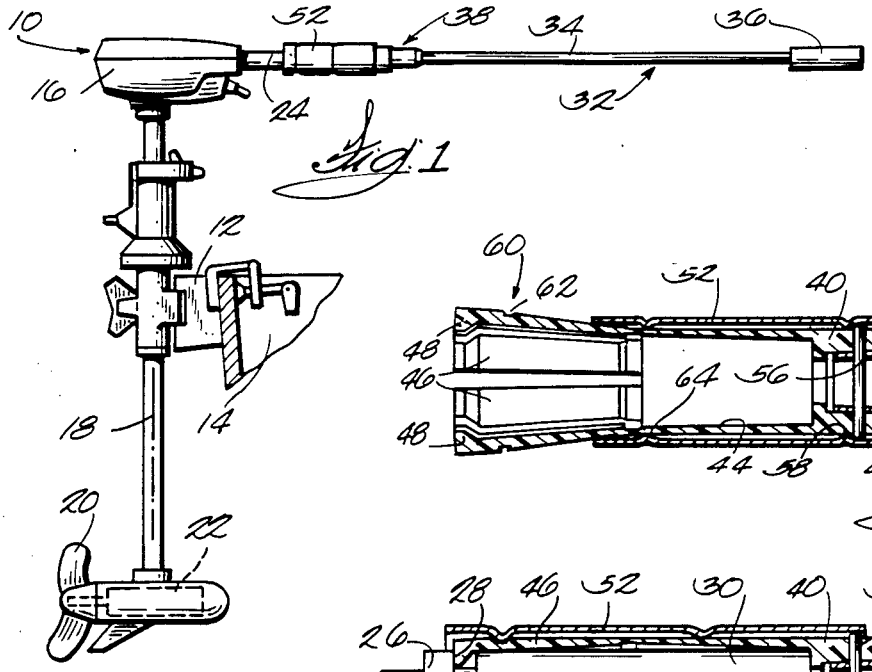
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine proplusion device 10 comprises a mounting bracket 12 fixedly attached to the transom of a boat 14, and a propulsion unit 16 pivotally mounted on the mounting bracket 12 for pivotal movement relative to the mounting bracket 12 and to the transom about a generally vertical steering axis 18. The proplusion unit 16 includes rotatably mounted propeller 20, and a powerhead 22 drivingly connected to the propeller 20. In the preferred embodiment, the marine proplusion device 10 is an electric outboard motor or trolling motor, and the powerhead 22 includes an electric motor (not shown). In alternative embodiments, the powerhead 22 can handle an internal combustion engine.

The marine proplusion device 10 further comprises a steering handle 24 connected to the propulsion unit 16 and extending generally horizontally therefrom for causing pivotal steering movement of the propulsion unit 16 in response to lateral movement of the steering handle 24. The steering handle 24 has an outer surface 26 and preferably includes a resiliently deformable hand grip 30 defining the outer surface 26. In the preferred embodiment, the steering handle 24 is rotatable for controlling motor speed.

The marine proplusion device 10 further comprises (see FIG. 1) an extension handle assembly 32 removably attached to the steering handle 24 to allow steering of the propulsion unit 16 and controlling of motor speed (by rotating the steering handle 24) from a remote location in the boat 14. The extension handle assembly 32 includes an extension handle 34 having opposite inner and outer ends, the outer end having mounted thereon a hand grip 36.

Figure 2:
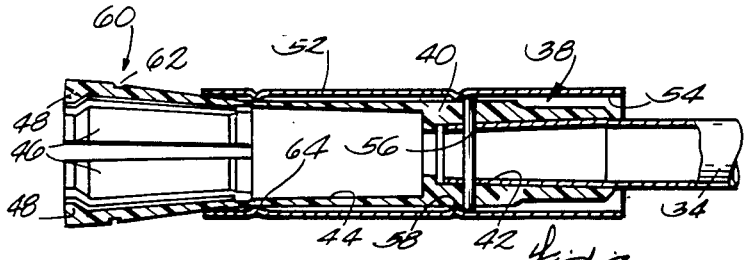
FIG. 2 is a cross-sectional view of the extension handle assembly.
Figure 3:
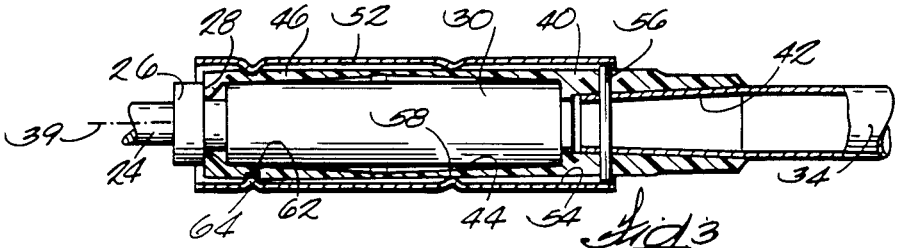
FIG. 3 is a cross-sectional view of the extension handle assembly showing the sleeve in the locked position and showing the steering handle.

As shown in FIGS. 2–5, the handle assembly 32 also includes a coupling device 38 having a longitudinal axis 39 (FIG. 3). Preferably, the coupling devide 38 includes a main portion 40 connected to the extension handle 34. In the preferred embodiment,t he main portion 40 includes a generally cylindrical recess 42 centered on the longitudinal axis 39 and receiving the inner end of the extnesion handle 34. In the illustrated construction, the inner end of the extension handle 34 is tapered and the recess 42 is tapered in complementary fashion. The main portion 40 preferably also includes a second generally cylindrical recess 44 centered on the longitudinal axis 39 and adapted to receive the outer portion of the steering handle 24, as shown in FIG. 3.

The coupling device 38 further includes a plurality of fingers 46 spaced around the recess 44 and thus around the longitudinal axis 39 and having respective inner or right ends pivotally connected to the main portion 40 and respective outer or left ends biased outwardly from the longitudinal axis 39. When the extension handle assembly 32 is attached to the steering handle 24, as shown in FIG. 3, the fingers 46 are spaced around the steering handle 24 and the outer ends are biased outwardly from the steering handle 24. The fingers 46 also include respective outer surfaces 50.

Figure 4:
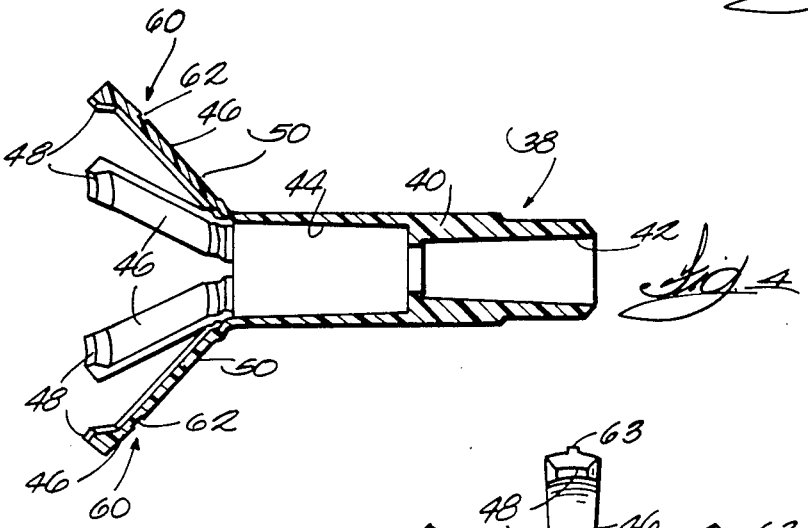
FIG. 4 is a cross-sectional view of the coupling device of the extension handle assembly.
Figure 5:
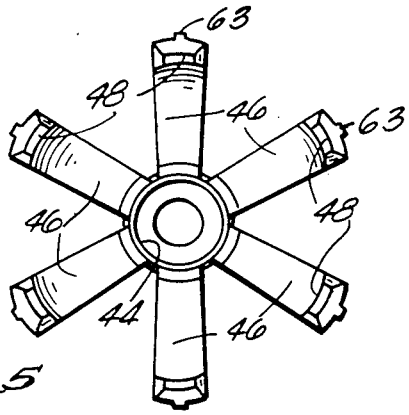
FIG. 5 is an end view of the coupling device as shown in FIG. 4.

Preferably, the fingers 46 are integrally connected to the main portion 40 and the entire coupling device 38 is made of a resiliently deformable material with the fingers 46 being natrually biased outwardly to the position shown in FIG. 4.

In alternative embodiments (not shown), the fingers 46 can be separate from the main portion 40. Any suitable means, such as hinges, can be used to pivotally connect the fingers 46 to the main portion 40, and any suitable biasing means, such as torsion springs, can be used to bias the fingers 46 outwardly.

It should be understood that while in the preferred embodiment the coupling device 38 includes the main portion 40 connected between the fingers 46 and the extension handle 34, in alternative embodiments, the fingers 46 can be connected to the extension handle 34 by any suitable means. For example, the fingers 46 can be connected directly to the extension handle 34.

The marine propulsion device 10 preferably further comprises cooperating means on the steering handle 24 and on the extension handle assembly 32 for preventing axial movement of the extension handle assembly 32 relative to the steering handle 24. While various suitable means can be employed, in the preferred embodiment, such means includes, on the outer surface 26 of the steering handle 24, detent means, and, on the fingers 46, respective projections 48 extending inwardly toward the steering handle 24 or longitudinal axis 39 for engaging the detent means on the steering handle 24. While various suitable detent means can be used, in the illustrated construction, the detent means includes (see FIG. 3) a groove 28 in the outer surface 26 of the steering handle 24. Preferably, the projections 48 are located adjacent the outer ends of the fingers 46 and are received in the groove 28.

The extension handle assembly 32 further includes cylindrical sleeve means 52 surrounding the coupling device 38 and being slideable around the fingers 46 longitudinally thereof for moving the outer ends of the fingers 46 inwardly such that the fingers 46 grasp the steering handle 24. The sleeve means 52 is slideable along the longitudinal axis 39 between a retracted position shown in FIG. 2 and a locked position shown in FIG. 3, the locked position being spaced from the retracted position in the direction (toward the left in the drawings) from the inner ends of the fingers 46 to the outer ends of the fingers 46. When the sleeve means 52 is in the retracted position (FIG. 2), the fingers 46 extend outwardly. As the sleeve means 52 moves from the retracted position to the locked position (FIG. 3), the sleeve means 52 moves the outer ends of the fingers 46 inwardly such that the fingers 46 grasp the steering handle 24. When the sleeve means 52 is in the locked position, the fingers 46 are locked around the steering handle 24. The locking of the sleeve means 52 is explained hereinafter. In the preferred embodiment, the sleeve means 52 includes a generally cylindrical inner surface 54.

The extension handle assembly 32 preferably further includes means for limiting movement of the sleeve means 52 relative to the coupling device 38 and in the direction from the outer ends of the fingers 46 to the inner ends of the fingers 46, or for limiting movement of the sleeve means 52 to the right as shown in FIG. 2. While various suitable limiting means can be employed, in the preferred embodiment, the limiting means includes, on the main portion 40 of the coupling device 38, projection means, and means 58 extending inwardly from the inner surface 54 of the sleeve means 52 for engaging the projection means.

While various suitable projection means can be used, in the preferred embodiment, the projection means includes a pin 56 (FIGS. 2 and 3) extending through the main portion 40 of the coupling device 38 and having a portion extending outwardly from the main portion 40. In the preferred embodiment, the pin 56 also extends through the inner end of the extension handle 34.

While various suitable means 58 for engaging the projection means can be used, in the illustrated construction, the engaging means 58 includes an annular ridge 58 extending inwardly from the inner surface 54 of the sleeve means 52 and engaging the pin 56.

The extension handle assembly 32 preferably further includes means for securing the sleeve means 52 in the locked position (FIG. 3). While various suitable securing means can be employed, in the preferred embodiment, the securing means includes detent means 60 on the outer surfaces 50 of the fingers 46, and means extending inwardly from the inner surface 54 of the sleeve means 52 for engaging the detent means 60.

Figure 6:
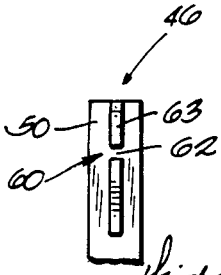
FIG. 6 is an enlarged view of the outer surface of one of the fingers.

While various suitable detent means 60 can be employed, in the preferred embodiment, the detent means 60 includes respective recesses 62 which define an annular groove extending around the outer surfaces 50 of the fingers 46. Preferably, as shown in FIG. 6, the outer surface 50 of each finger 46 includes a longitudinally extending ridge 63 which defines the respective recess 62. While various suitable means for engaging the detent means 60 can be used, in the illustrated construction, the engaging means includes (see FIGS. 2 and 3) an annular ridge 64 extending inwardly from the inner surface 54 and being receivable in the groove defined by the recesses 62.

The sleeve means 52 is shown in FIG. 3 in the locked position with the ridge 64 received in the recesses 62. In the preferred embodiment, the ridge 64 also engages the outer surfaces 50 (specifically the ridges 63) of the fingers 46 for moving the fingers 46 inwardly during movement of the sleeve means 52 toward the outer ends of the fingers 46.

The extension handle assembly 32 preferably further includes means for securing the inner end of the extension handle 34 to the coupling device 38. While various suitable securing means can be used, in the illustrated construction, the securing means includes the pin 56.

The extension handle assembly 32 is attached to the steering handle 24 as follows: With the sleeve means 52 in the retracted position, the fingers 46 are placed around the steering handle 24 such that the outer end of the steering handle 24 is located in the recess 44. The sleeve means 52 is then moved to the locked position wherein the ridge 64 is received in the receses 62. This movement causes the outer ends of the fingers 46 to move inwardly such that the fingers 46 grasp the steering handle 24 and the projections 48 on the fingers 46 are received in the groove 28 on the steering handle 24. The fingers 46 grasp the steering handle 24 tightly enough so that rotation of the extension handle assembly 32 causes rotation of the steering handle 24.

Various features and advantage of the invention are set forth in the following claims.

We claim:

1. A marine propulsion device comprising a propulsion unit adapted to be pivotally mounted on a boat for pivotal movement relative to the boat about a generally vertical steering axis, said propulsion unit including a rotatably mounted propeller, and a powerhead drivingly connected to said propeller, a steering handle connected to said propulsion unit and extending generally horizontally therefrom for causing pivotal steering movement of said propulsion unit in response to lateral movement of said steering handle, and an extension handle assembly removable attached to said steering handle and including an extension handle, a coupling member including a main portion connected to said extension handle and a plurality of fingers spaced around said steering handle and having respective inner ends pivotally connected to said main portion, and respective outer ends movable outwardly from said steering handle, and cylindrical sleeve means having a fixed inner diameter, surrounding said coupling member, and being slideable longitudinally of said coupling member between a first position in surrounding relation to said main body and clear of said fingers and a second position longitudinally spaced from said first position and in surrounding relation to said fingers with said outer ends thereof located radially inwardly such that said fingers grasp said steering handle.

2. A marine proplusion device as set forth in claim 1 wherein said assembly further includes means for limiting movement of said sleeve means relative to said coupling member and in the direction from said outer ends to said inner ends.

3. A marine propulsion device comprising a propulsion unit adapted to be pivotally mounted on a boat for pivotal movement relative to the boat about a generally vertical steering axis, said propulsion unit including a rotatably mounted propeller, and a powerhead drivingly connected to said propeller, a steering handle connected to said propulsion unit and extending generally horizontally therefrom for causing pivotal steering movement of said propulsion unit in response to lateral movement of said steering handle, and an extension handle assembly removably attached to said steering handle and including an extension handle, a coupling member including a plurality of fingers spaced around said steering handle and having respective inner ends pivotally connected to said extension handle, and respective outer ends biased outwardly from said steering handle, cylindrical sleeve means surrounding said coupling member and including a generally cylindrical inner surface, and being slideable around said fingers longitudinally thereof for moving said outer ends inwardly such that said fingers grasp said steering handle, and means for limiting movement of said sleeve means relative to said coupling member and in the direction from said outer ends to said inner ends, said limiting means including, on said coupling member, projection means, and, on said sleeve means, means extending inwardly from said inner surface for engaging said projection means.

4. A marine propulsion device as set forth in claim 3 wherein said projection means includes a pin extending through said coupling member and having a portion extending outwardly from said coupling member, and wherein said engaging means includes an annular ridge extending inwardly from said inner surface of said sleeve means.

5. A marine propulsion device as set forth in claim 1 wherein said assembly futher includes means for securing said sleeve means in a position locking said fingers around said steering handle.

6. A marine propulsion device comprising a propulsion unit adapted to be pivotally mounted on a boat for pivotal movement relative to the boat about a generally vertical steering axis, said propulsion unit including a rotatably mounted propeller, and a powerhead drivingly connected to said propeller, a steering handle connected to said propulsion unit and extending generally horizontally therefrom for causing pivotal steering movement of said propulsion unit in response to lateral movement of said steering handle, and an extension handle assembly removably attached to said steering handle and including an extension handle, a coupling member including a plurality of fingers spaced around said steering handle and having respective inner ends pivotally connected to said extension handle, and respective outer ends biased outwardly from said steering handle, cylindrical sleeve means surrounding said coupling member and being slideable around said fingers longitudinally thereof for moving said outer ends inwardly such that said fingers grasp said steering handle, and means for securing said sleeve means in a position locking said fingers around said steering handle, said securing means including, on said fingers, respective outer surfaces having thereon detent means, and, on said sleeve means, a generally cylindrical inner surface, and means extending inwardly from said inner surface for engaging said detent means.

7. A marine propulsion device as set forth in claim 6 wherein said detent means includes an annular groove extending around said outer surfaces of said fingers, and wherein said engaging means includes an annular ridge extending inwardly from said inner surface and being receivable in said groove.

8. A marine propulsion device as set forth in claim 1 and further comprising cooperating means on said steering handle and on said extension handle assembly for preventing axial movement of said extension handle assembly relative to said steering handle.

9. A marine propulsion device as set forth in claim 8 wherein said steering handle has an outer surface, and wherein said means for preventing axial movement of said extension handle assembly includes, on said outer surface of said steering handle, detent means, and, on said fingers, respective projections extending inwardly toward said steering handle for engaging said detent means.

10. An extension handle assembly adapted to be removably attached to an outboard motor steering handle, said assembly comprising an extension handle, a coupling apparatus having a longitudinal axis and including a main portion connected to said extension handle and having therein a cylindrical recess centered on said longitudinal axis and adapted to receive a portion of the steering handle, and a plurality of fingers connected to said main portion around said recess, said fingers being adapted to have the steering handle inserted therewithin and including respective inner ends movably connected to said main portion, respective outer ends biased outwardly from said longitudinal axis, respective outer surfaces having therein respective recesses defining an annular groove extending around said outer surfaces, and respective projections extending inwardly toward said longitudinal axis for engaging the steering handle, cylindrical sleeve means surrounding said coupling apparatus and being slideable around said fingers longitudinally thereof for moving said outer ends inwardly such that said fingers grasp the steering handle with said projections engaging the steering handle, said sleeve means including a generally cylindrical inner surface, a first annular ridge extending inwardly from said inner surface, and a second annular ridge spaced from said first ridge in the direction from said inner ends to said outer ends, said second ridge extending inwardly from said inner surface and being receivable in said groove, and a pin extending through said main portion and having a portion extending outwardly from said main portion, said portion of said pin being engageable by said first ridge for limiting movement of said sleeve means relative to said coupling apparatus and in the direction from said outer ends to said inner ends.

11. A marine propulsion device as set forth in claim 1 wherein said main portion of said coupling member includes a cylindrical recess receiving a portion of said steering handle, and wherein said fingers are connected to said main portion around said recess.

12. A marine propulsion device as set forth in claim 1 wherein said extension handle has an inner end, and wherein said main portion of said coupling member includes a cylindrical recess receiving said inner end of said extension handle.

13. A marine propulsion device as set forth in claim 12 wherein said extension handle assembly further includes means for securing said inner end of said extension handle to said coupling member.

14. A marine propulsion device as set forth in claim 13 wherein said securing means includes a pin extending through said main portion of said coupling member and through said inner end of said extension handle.

15. A marine propulsion device as set forth in claim 1 wherein said fingers have respective outer surfaces, and wherein said sleeve means includes a generally cylindrical inner surface, and an annular ridge extending inwardly from said inner surface and engaging said outer surfaces.

16. An extension handle assembly adapted to be removably attached to an outboard motor steering handle, said assembly comprising an extension handle, a coupling member having a longitudinal axis and including a main body connected to said extension handle and a plurality of fingers spaced around said longitudinal axis and having respective inner ends pivotally connected to said main body, and respective outer ends movable outwardly from said longitudinal axis, said fingers being adapted to have the steering handle inserted therewithin, and cylindrical sleeve means having a fixed inner diameter, surrounding said coupling member, and being slideable longitudinally of said coupling member between a first position in surrounding relation to said main body and clear of said fingers and a second position longitudinally spaced from said first position and in surrounding relation to said fingers with said outer ends thereof located radially inwardly such that said fingers grasp the steering handle.

17. An assembly as set forth in claim 16 and further comprising means for limiting movement of said sleeve means relative to said coupling member and in the direction from said outer ends to said inner ends.

18. An extension handle assembly adapted to be removably attached to an outboard motor steering handle, said assembly comprising an extension handle, a coupling member having a longitudinal axis and including a plurality of fingers spaced around said longitudinal axis and having respective inner ends pivotally connected to said extension handle, and respective outer ends biased outwardly from said longitudinal axis, said fingers being adapted to have the steering handle inserted therewithin, cylindrical sleeve means surrounding said coupling member and including a generally cylindrical inner surface, and being slideable around said fingers longitudinally thereof for moving said outer ends inwardly such that said fingers grasp the steering handle, and means for limiting movement of said sleeve means relative to said coupling member and in the direction from said outer ends to said inner ends, said limiting means including, on said coupling member projection means, and, on said sleeve means, means extending inwardly from said inner surface for engaging said projection means.

19. An assembly as set forth in claim 18 wherein said projection means includes a pin extending through said coupling member and having a portion extending outwardly from said coupling member, and wherein said engaging means includes an annular ridge extending inwardly from said inner surface of said sleeve means.

20. An assembly as set forth in claim 16 and further comprising means for securing said sleeve means in a position locking said fingers around the steering handle.

21. An extension handle assembly adpated to be removably attached to an outboard motor steering handle, said assembly comprising an extension handle, a coupling member having a longitudinal axis and including a plurality of fingers spaced around said longitudinal axis and having respective inner ends pivotally connected to said extension handle, and respective outer ends biased outwardly from said longitudinal axis, said fingers being adapted to have the steering handle inserted therewithin, cylindrical sleeve means surrounding said coupling member and being slideable around said fingers longitudinally thereof for moving said outer ends inwardly such that said fingers grasp the steering handle, and means for securing said sleeve means in a position locking said fingers around the steering handle, said securing means including, on said finges, respective outer surfaces having thereon detent means, and, on said sleeve means, a generally cylindrical inner surface, and means extending inwardly from said inner surface for engaging said detent means.

22. An assembly as set forth in claim 21 wherein said detent means includes an annular groove extending around said outer surfaces of said fingers, and wherein said engaging means includes an annular ridge extending inwardly from said inner surface and being receivable in said groove.

23. An assembly as set forth in claim 16 wherein said fingers include respective projections extending inwardly toward said longitudinal axis for engaging the handle.

24. An assembly as set forth in claim 16 wherein said fingers have respective outer surfaces, and wherein said sleeve means includes a generally cylindrical inner surface, and an annular ridge extending inwardly from said inner surface and engaging said outer surfaces.

25. An assembly as set forth in claim 16 wherein said main portion of said coupling member includes a cylindrical recess adapted to receive a portion of the steering handle, and wherein said fingers are connected to said main portion around said recess.

26. An assembly as set forth in claim 16 wherein said extension handle has an inner end, and wherein said main portion of said coupling member includes a cylindrical recess receiving said inner end of said extension handle.

27. An assembly as set forth in claim 26 and further comprising means for securing said inner end of said extension handle to said coupling member.

28. An assembly as set forth in claim 27 wherein said securing means includes a pin extending through said main portion of said coupling member and through said inner end of said extension handle.

* * * * *